US006772670B2

(12) United States Patent
Koursakoff

(10) Patent No.: US 6,772,670 B2
(45) Date of Patent: Aug. 10, 2004

(54) OPERATING METHOD FOR AUTOMATIC WEAPONS AND AUTOMATIC REVOLVER BASED THEREON

(76) Inventor: Alexandr Alexandrovich Koursakoff, ul. Novgorodskaye, 24-118, Moscow, 127572 (RU)

( * ) Notice: Subject to any disclaimer, the term of this patent is extended or adjusted under 35 U.S.C. 154(b) by 0 days.

(21) Appl. No.: 10/182,326

(22) PCT Filed: Dec. 20, 2001

(86) PCT No.: PCT/RU01/00558

§ 371 (c)(1),
(2), (4) Date: Jul. 25, 2002

(87) PCT Pub. No.: WO02/50845

PCT Pub. Date: Jun. 27, 2002

(65) Prior Publication Data

US 2003/0116008 A1 Jun. 26, 2003

(30) Foreign Application Priority Data

Feb. 26, 2001 (RU) ..... 2001 105154/02

(51) Int. Cl.[7] ..... F41A 3/38
(52) U.S. Cl. ..... 89/157; 89/190; 42/65
(58) Field of Search ..... 89/155, 157, 168, 89/169, 171, 172, 175, 176, 190; 42/63, 64, 65, 67, 68

(56) References Cited

U.S. PATENT DOCUMENTS 584,631 A * 6/1897 Fosbery
944,448 A * 12/1909 Lefever
1,985,493 A * 12/1934 Gebauer et al.
2,600,007 A * 6/1952 Lippert ..... 89/176
3,000,268 A * 9/1961 Robinson ..... 89/189
3,055,270 A * 9/1962 Miller ..... 89/157
4,151,782 A * 5/1979 Allen ..... 89/155
4,934,247 A * 6/1990 Piscetta ..... 89/163
5,415,075 A * 5/1995 Moon ..... 89/163
5,734,120 A * 3/1998 Besselink ..... 89/163
6,112,636 A * 9/2000 Besselink ..... 89/191.01

FOREIGN PATENT DOCUMENTS

DE 114184 * 10/1900 ..... 89/155

* cited by examiner

*Primary Examiner*—Stephen M. Johnson
(74) *Attorney, Agent, or Firm*—Frishauf, Holtz, Goodman & Chick, P.C.

(57) ABSTRACT

Operating method of automatic fire-arms and automatic revolver based on this method. The operation method involves turning the arm barrel unit in a vertical plane relative to a transversal horizontal axle connecting the arm barrel unit with the frame occurring as a result of action of the arm of force. The automatic revolver contains the barrel unit with the cylinder connected with the frame by the transversal axle, a grip and the slide is located in the barrel unit. The slide includes a slide retainer, slide accelerator, mechanism for translational-rotational movement of the slide and an engagement unit for causing engagement between fired cartridge-case bottom the slide cup. The arm kickback compensator is located inside the grip in a cavity and includes a retainer movably fastened to a rear wall of an upper part of the grip defining the cavity. The technical result of the method and automatic revolver is the elimination of the negative influence of the arm of force occurred in shooting.

14 Claims, 5 Drawing Sheets

OPERATING METHOD FOR AUTOMATIC WEAPONS AND AUTOMATIC REVOLVER BASED THEREON

This application is a U.S. National Phase Application under 35 U.S.C. 371 of International Application No. PCT/RU01/00558 filed Dec. 20, 2001.

FIELD OF THE INVENTION

The invention relates to the operation method of automatics of manual fire-arms and to the design of an automatic revolver based on this method. The invention can serve as basic model to create a practically new class of automatic revolvers.

BACKGROUND OF THE INVENTION

The various technical solutions for arm automatics are known but all they use the linear principle of automatics action, i.e., such as those in which the vectors determining the movement of mass centers of movable arm parts, sensing and transmitting the kickback pulse-have the linear direction, induce to perform the linear movement.

The nearest analogue is the method of arm automatics action in the process of shooting containing the barrel unit movement occurring as a result of action of the arm of force ("Small Arms", 4-th edition, corr. and suppl.—Minsk: "Pot-Pourri Co, Ltd", 1999, p. 29).

In shooting the slide being thrusted back by kickback force leads away the barrel with it. Moving back, the barrel at the same time moves down because it is connected with fixed body by means of the shackle being in rotational movement. The barrel stops and the slide is moving backwards under the action of inertia and the powder gas residual pressure on the cartridge-case bottom.

The present solution uses also the linear principle of automatics action with all shortcomings followed from it.

It is known the various models of automatic revolvers using the linear principle of automatics action for automatics operation.

It is known the model *Mateba Autorevolver* "6 Unica" using for automatics the return motion of mainspring force which serves at the same time as the recoil spring of movable parts (Magazine "Gun"—1998, Nr. 3, p. 29–32). In this model, the mechanism for barrel operation control is located in upper mobile part of the fire-arms. The barrel of this revolver is connected with lower powder-chamber of the cylinder.

The shortcoming of the known model is the fact that the automatics principle is practically carried from other kinds of automatic arms. Therefore, in this case, the mass of movable parts is compared with the mass of the whole arm and affects to the operation reliability not by the best manner.

It is known the method of arm magazine re-loading and the automatic revolver with magazine delivery using the powder gas energy and the recoil spring one for automatics by means of the drive rod passing through the central hole of cylinder and actuating the automatics (Patent of RF Nr. 2130157, IPC: F 41 C 3/00, F 41 A 9/00, Oct. 5, 1999).

The known solution relates to the automatics system of small arms of revolver type but not of revolver class. The design of the known automatic revolver is complicated for its fabrication and its action is not flawless because of numerous pieces necessary for realizing the invention.

The nearest analogue is the automatic revolver "Webley-Fosbery", model 1900, modification 1901–1902, consisting of a frame and an upper movable part. The frame has the guides on which the upper part can move. Under the kickback action, the upper part with barrel and cylinder is displacing backwards and then is returning thereby cocking the hammer and turning the cylinder (Magazine "Arms"—2000, Nr. 2, p. 56–58.

The various versions of this revolver are known including the civil and military models.

The cylinder of this revolver has the grooves in which the head of fixed screw projecting out of frame immobile part is taken. These grooves are subjected to be contaminated and it can bring to the failure of automatics mechanism. Besides that, in the case of misfire, the cylinder isn't turning by simple pressing the trigger or by cocking the hammer.

The known technical solutions use the linear principle of automatics action, i.e. such as those in which the vectors determining the movement of mass centers of movable arm parts sensing and transmitting the kickback pulse have the linear direction, induce to perform the linear movement.

SUMMARY OF THE INVENTION

The proposed technical solution hasn't the analogues among the known solutions of short-barrel arms of revolver type.

There is proposed the non-linear principle of arm automatics operation in which the vectors determining the movement of mass centers of arm movable parts sensing and transmitting the kickback pulse in the process of shooting, have the variable direction.

The technical result of the method in accordance with the invention is the elimination of the negative influence of the arm of force occurring in shooting, by using it for actuation of arm automatics, the complete automation of shooting technology operations, the increase of arm firing qualities, of stability, of fire rate, of reliability in use, of improvement of technical and functional characteristics, the ability to create the arm of new type.

The technical result is attained by using the kickback pulse reaction of a barrel unit fastened movably in an arm frame on the axle being on the line not coinciding with the line of barrel bore.

The technical result is attained by using for arm automatics operation, in shooting, the method containing the barrel unit movement as a result of action of the arm of force. In the time of shooting, the barrel unit is turning in vertical plane relative to a transversal horizontal axle connecting the barrel unit with the frame and the arm of force is creating between the barrel unit being on the line of powder gas action and of transversal horizontal axle located on the line of action of an arm reaction force parallel to the line of action of powder gas in the process of shooting.

The barrel unit is turning at the angle from 5 to 15°

The barrel unit can contain the slide with retainer and slide accelerator. In this case, the movement of arm movable part in vertical plane is occurring as a result of action of the arm of force formed in the process of shooting, between the line of powder gas action (transversal horizontal axle) and the force of support reaction (the part of slide—the slide cup).

The method in accordance with the invention improves considerably the technical features and the modes of arm use in case of its application.

The practical use of the method of arm automatics operation in accordance with the invention is possible for various kinds of short-barrel arms not only of revolver type. The method gives an opportunity to create the various modifications of reliable, handy in use, powerful quick-firing arms of revolver type both classic look and with elements of modern design.

The negative influence of the arm of force occurring in shooting is used in the method in accordance with the invention for actuation of arm automatics, thereby removing the throw-back of the arm and imparting to the arm such features as the stability which provides the arms with improved qualities, such as the precision and the safety in the case of prolonged shooting and permits to spend less energy for shooter.

The technical result of the invention is the creation of automatic revolvers with high fighting qualities, handy in application, reliable in use, with optimum ergonomics and large opportunities for functional design.

The technical result is obtained by the special constructive design of the automatic revolver. The automatic revolver in accordance with the invention contains the barrel unit with cylinder, the frame with grip. The barrel unit and the frame are connected movably to one another. The automatic revolver is provided with the slide located in the barrel unit and having tubular and rear parts. The tubular part of the slide is placed under the barrel, inside this part are located the recoil spring and mainspring with rod. The slide is provided with slide retainer, slide accelerator, mechanism for translational-rotational movement of the slide and with rigid engagement unit of fired cartridge-case bottom with slide cup. In this case, the tubular part of the slide is also the axle of cylinder rotation which has the catch disposed in front of the cylinder. The arm kickback compensator is located inside the grip. The barrel unit is connected with the frame by transversal axle located under the cylinder with ability to turn the barrel unit relative to this axle.

The arm kickback compensator is disposed inside the grip in a specially provided cavity. It includes a compensator body fastened movably in the grip cavity and in contact with the slide retainer by means of a movable lever system, as the lever accelerator and the transmitting rod. The compensator body has the groove with open upper end in which is disposed the recoil spring and the push-rod of the recoil spring, this push-rod by one end enters the groove and interacts with the recoil spring of the compensator and by other end is in contact with a rear part of the barrel unit. The compensator is provided with retainer which is movably fastened on the transversal axle in the cavity of a rear wall of he upper part of the grip.

The mechanism for translational-rotational movement of the slide is the curvilinear copy slot which is on the outer surface of the slide tubular part and the guide tooth interacting with the slot in the process of shooting disposed in the slide groove.

The rigid engagement unit of the fired cartridge-case with slide cup is performed as the spring-loaded breech-ring and the spring-loaded cartridge-case extractor.

The slide retainer is the plate with cocking tooth movably fastened on the transversal axle. The cocking tooth is in upper part of slide retainer between the slide retainer presenting the double-armed lever movable fastened on the axle.

DETAILED DESCRIPTIONOF THE INVENTION

Figure 1A:
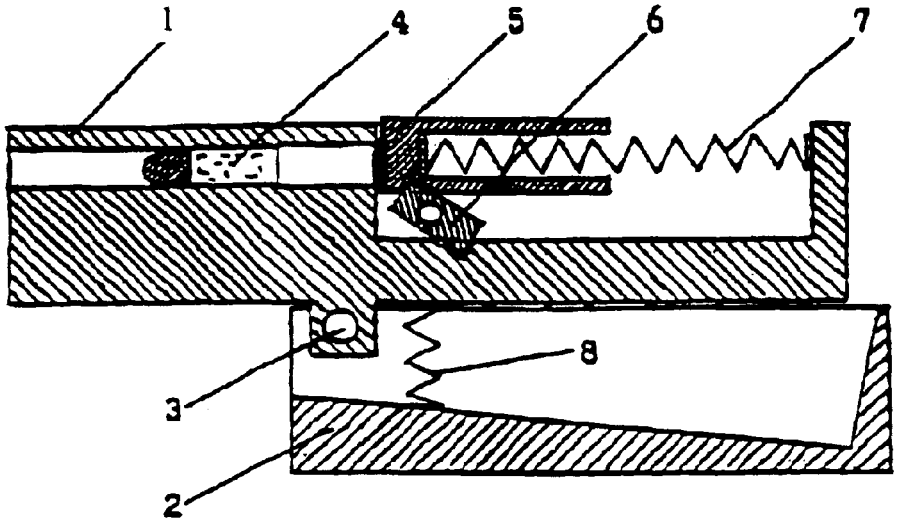
FIG. 1A shows arm automatics operation in an initial position from the outset of the shot.
Figure 1B:
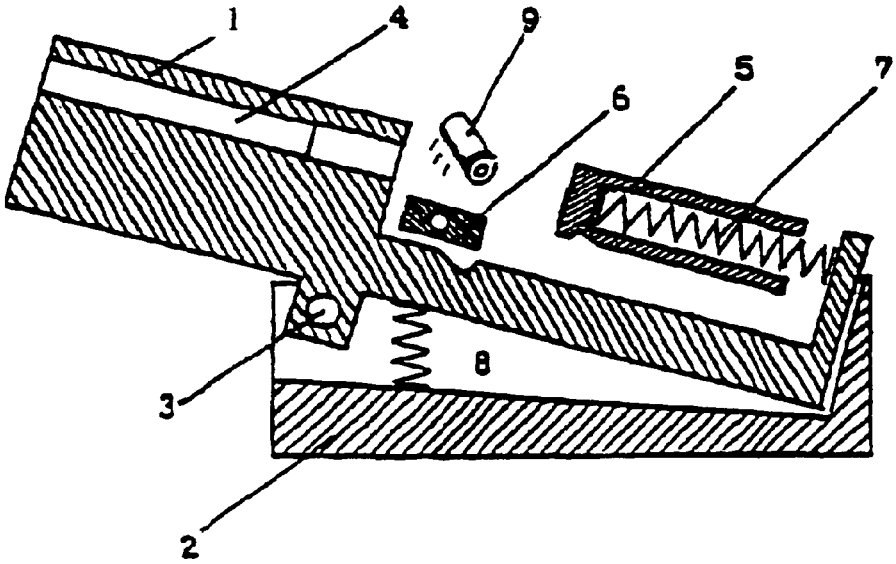
FIG. 1B shows the operation of the automatic arm after the bullet has gone out of barrel.

FIGS. 1A and 1B show conventionally the barrel unit 1 connected with the arm frame 2 by transversal horizontal axle 3 with the ability to move around this axle in vertical plane. The barrel unit 1 has the barrel groove or bore 4, the slide 5, the slide locking mechanism or the slide retainer 6 and the slide recoil spring 7. FIGS. 1A and 1B also show conventionally the return or recoil mechanism 8 of the barrel unit 1 and the cartridge-case 9.

In the initial position shown in FIG. 1A, the slide 5 is locked. When shooting, the barrel unit 1 begins to move in a vertical plane in one direction as a result of the bullet coming out of the barrel. When the deviation is at the small angle (from 5 to 15°), the slide retainer 6 changes its position. The slide 5 is released and then it moves backwards under the action of powder gas residual pressure or because of other influences, for example, of the slide accelerator. As a result, the cartridge-case 9 is extracted and the mainspring is cocked (see FIG. 1B).

Then the slide recoil spring 7 advances the slide 5 thereby ensuring the arm charging with the next cartridge. At the same time, the recoil mechanism 8 of barrel unit 1 returns the barrel unit 1 to its initial position. The slide retainer 6 is returned in the position which was occupied by it before the shot, and locks the slide 5.

Figure 2:
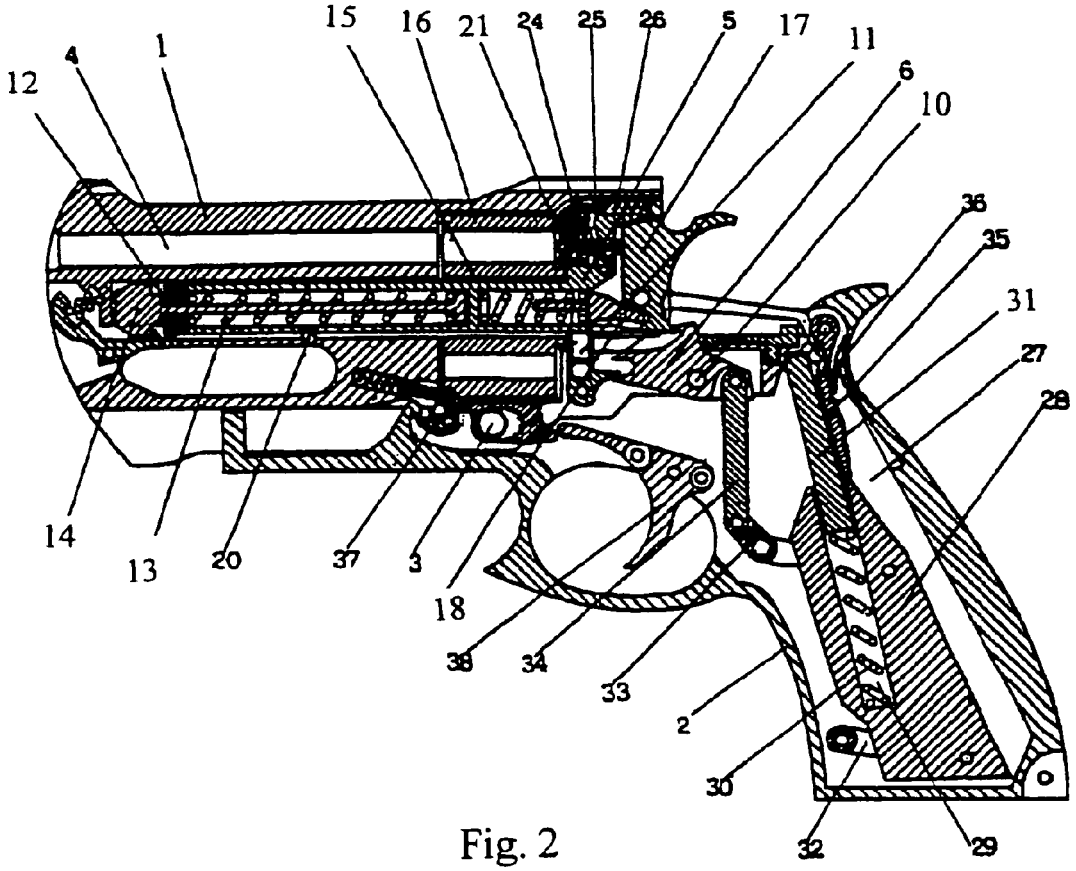
FIG. 2 shows a general view of the automatic revolver in accordance with the invention.
Figure 3:
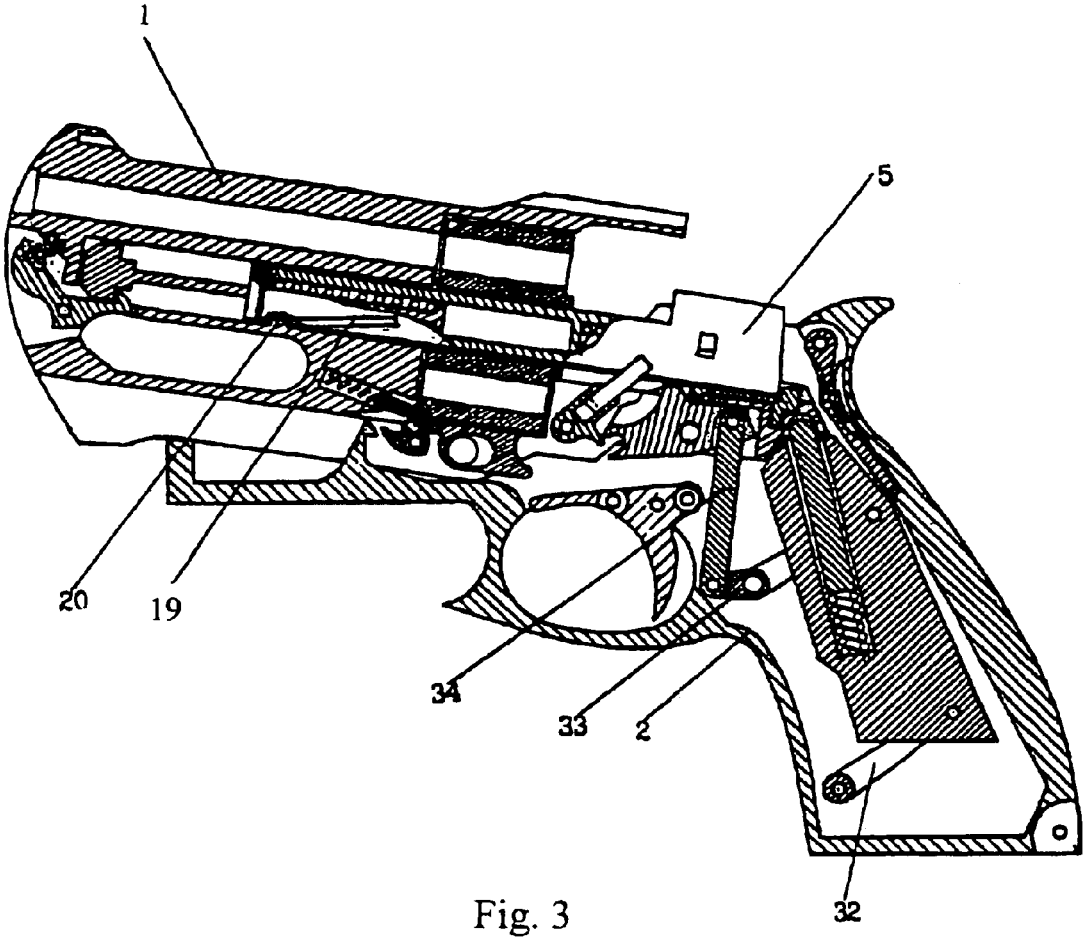
FIG. 3 shows the automatic revolver in the final phase of shooting.

The automatic revolver (FIGS. 2, 3) includes barrel unit 1 connected with the frame 2 by transversal axle 3. The movable barrel unit I contains the barrel groove 4, the slide locking mechanism consisting in the slide retainer 6 as a double-armed lever fixed to transversal axle 10 and the slide accelerator 11 interacting with it. The design of the slide 5 consists in tubular and rear parts. The tubular part of the slide 5 is located in the slide groove 12 which is under the barrel groove 4, the recoil spring 13 with retainer rod 14 and the slide mainspring 15 are placed in tubular part of the slide 5, in two separate cavities. The tubular part of the slide is also the axle of cylinder 16. The slide retainer 6 is provided with a cocking tooth and is connected with a compensator body located in the grip by a transmitting lever system.

The transversal axle 3 of the automatic revolver is disposed under the cylinder 16. The hammer 17 interacts with slide mainspring 15 by means of mainspring push rod 18.

On the outer surface of tubular part of the slide 5 is the copy slot 19 with which the guide tooth 20 located in the slide groove 12 interacts when shooting.

Figure 4A:
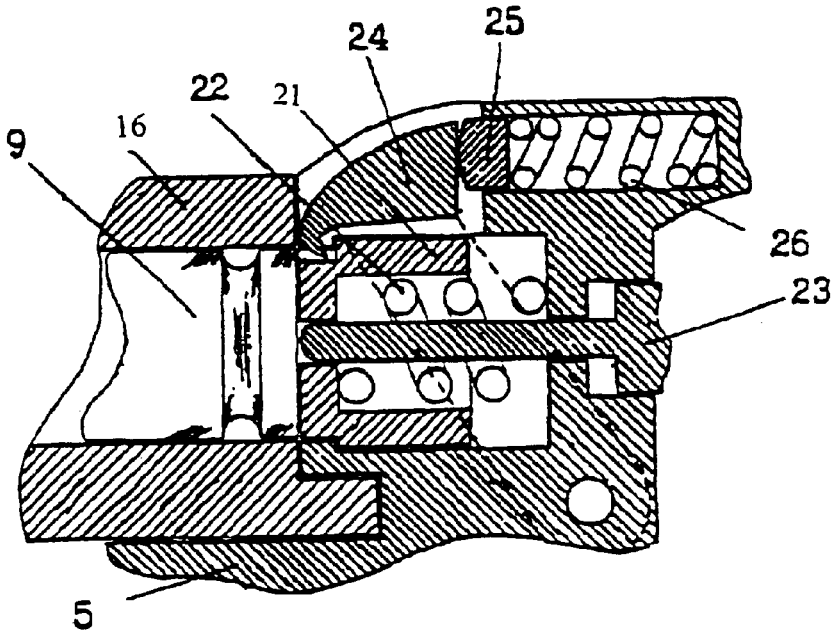
FIG. 4A shows the engagement of the cartridge-case bottom with the slide cup in a position before shooting.
Figure 4B:
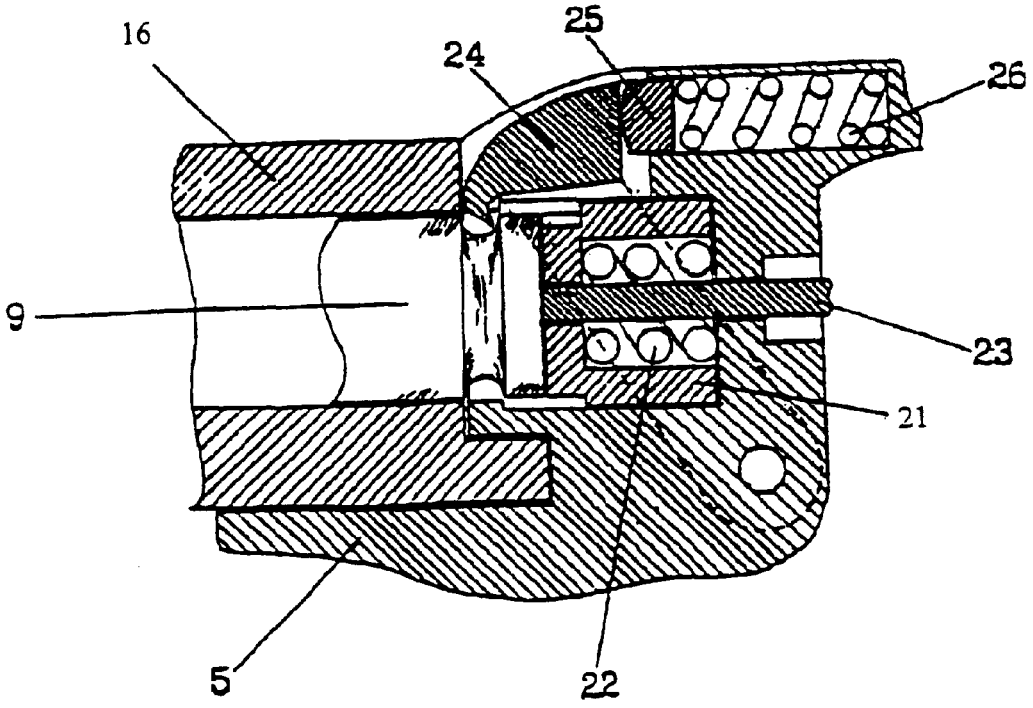
FIG. 4B shows the engagement of the cartridge-case bottom with the slide cup in a position after the fired shot.

The breech ring 21 joining to the powder-chamber of the cylinder 16 has the spring 22 inside of which is the firing pin 23 (see FIGS. 4A and 4B).

The cartridge-case extracting mechanism includes extractor push rod 25 and extractor spring 26 and is disposed over the breech ring 21.

The frame 2 connected with movable barrel unit 1 contains the revolver grip inside of which is the cavity 27. The arm kickback compensator is located in the grip cavity 27. The arm kickback compensator has the compensator body 28 having the groove 29 within it. The upper end of groove 29 is open. The recoil spring 30 with which interacts the push rod 31 of compensator recoil spring is in the groove 29. The compensator body 28 is movably connected in the cavity 27 by means of single-armed guides, the lever 32 ensures necessary mobility of the compensator body. The compensator body 28 is in contact with the slide retainer 6 by double-armed accelerator of compensator 33 and transmitting rod 34 movably connected thereto. The compensator 33 is furnished with retainer 35 fixed in the upper part of the cavity 27 near the rear wall of the grip. The retainer 35 is spring-loaded by laminated spring 36.

The spring-loaded cylinder catch 37 is located in front of the cylinder in its lower part and is intended for stopping and fixing the cylinder in shooting.

The design assumes the rigid engagement of the fired cartridge-case bottom with the slide cup in shooting.

The cartridge-case the bottom of which is in rigid engagement with slide cup repeats the trajectory of the slide movement and transmits the movement torque to the arm cylinder. In the moment of extraction of fired cartridge-case out of powder chamber of cylinder, it is engaging with the cylinder retainer and ceases the rotational movement.

FIG. 4A shows the unit in which the cartridge-case 9 of upper powder chamber of cylinder 16 is joined to upper rear part of the slide 5 (slide cup). The engagement unit of fired cartridge-case bottom contains the breech ring 21 with breech ring spring 22. The scheme shows the firing pin 23. The mechanism for engagement and extraction of the cartridge-case 9 is located under the breech ring 21. It presents the spring-loaded extractor (ejector) 24 of the cartridge-case being in contact with extractor push rod 25 by means of the extractor spring 26.

As a result of the movement backwards of cartridge-case 9 when shooting, the cartridge-case bottom acts on the breech ring 21 and extends into the cavity of the slide cup. The spring-loaded extractor 24 of the cartridge-case with its shaped tooth enters the cartridge-case groove in the slide (see FIG. 4B). Such locking makes practically impossible the disengagement of the cartridge-case 9 from the shaped tooth of cartridge-case extractor 24.

Figure 5:
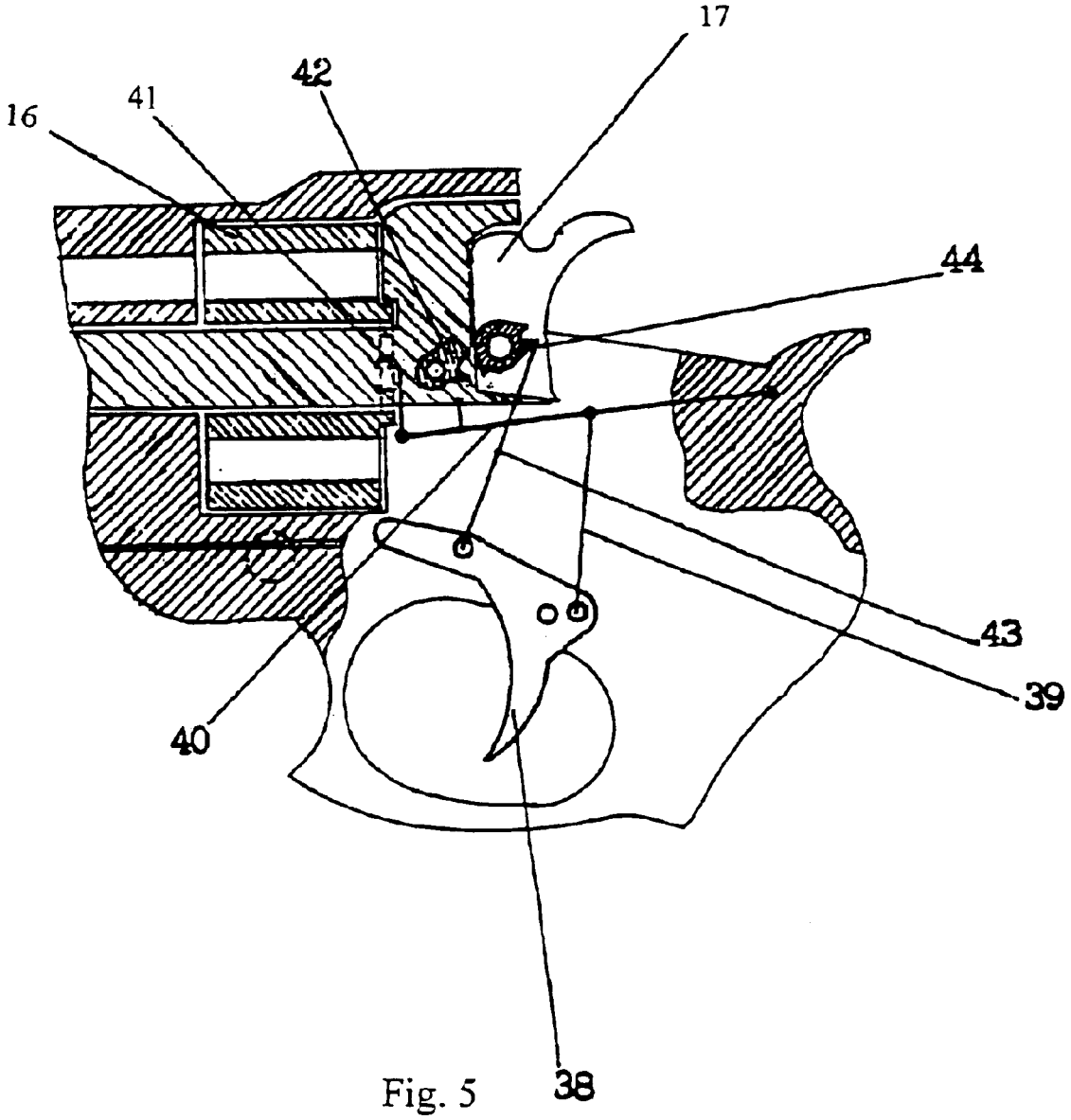
FIG. 5 shows the mechanism of shot control.

The shot is possible to do either in manual or automatic mode. The manual mode assumes two versions to do the shot: by self-cocking and by pulling the hammer cocked preliminary. The control of shooting is outlined in FIG. 5.

At the manual cocking, the hammer 17 acts on the trigger 38. The trigger 38 turning around its axle by means of push-rod 39 acts on the lateral lever 40. In its turn, the lateral lever 40 rotating on the fastening axle acts by special device on the lugs 41 made on the rear surface of cylinder 16 and turns the cylinder at the required angle. The rotation of cylinder becomes possible as a result of action of the trigger 38 on the cylinder catch 37 by special device.

At the complete turning backwards of the hammer 17, it is cocked and engaged with the sear 42.

When the hammer 17 is cocked by hand, the shot is accomplishing by light pressure on the trigger 38.

In shooting in the self-cocking mode, i.e., by pressing on trigger 38 without pre-cocking the hammer 17, the trigger 38 acts on the cocking lug 44 of the hammer 17 by means of cocking rod 43, and thus the hammer 17 is cocked. The rear short arm of the trigger 38 turns the cylinder 16 by push-rod 39 and lateral lever 40. At further pressing on the trigger 38, the cocking rod 43 is disengaging out of cocking lug 44 of the hammer 17 and it is resulting in the shot.

At automatic firing cock of the hammer, in shooting, the cocking rod 43 and the lateral lever 40 are taken aside by special lugs on the side of the barrel unit when it is turning. The next shot is analogous to that with the hammer pre-cocked by hand.

The shooting process of the automatic revolver is in following manner.

After the bullet is gone out of the barrel bore 4, as a result of kickback action, the barrel unit 1 is turning in a vertical plane around the axle 3 at some small angle (about 10°).

The turn of the barrel unit 1 may be divided conventionally into two phases. In the first phase of the turn of barrel unit 1, the hammer mainspring is cocking, the hammer 17 is in firing cock by means of cocking tooth of slide retainer 6 and the slide is released. In the first phase of the turn of barrel unit, the compensator body 28 is immobile.

In the second phase, as a result of released slide 5 the slide retainer 6 with the slide accelerator 11, thereby the slide accelerator 11 acts on the slide 5 and pushes it down.

By the interaction of the guide tooth 20 and the copy slot 19 located on the surface of slide tubular part, the slide 5 simultaneously with the translational movement performs also the rotational one.

The fired cartridge-case 9 being in the powder-chamber of the cylinder 16 is in rigid engagement with the slide cup. The slide moving backwards and turning around its axle induces the cartridge-case to repeat the trajectory of its movement.

Thereby, before the cartridge-case 9 is gone out of powder-chamber of cylinder 16, the cylinder 16 performs the rotational movement together with the slide. When the slide 5 reaches the rear limit position, the cartridge-case 9 interacts with the cartridge-case extractor 24 and leaves the limits of the arm. When the cylinder turns, the next powder-chamber with cartridge is in firing position, i.e., on the same line with the barrel 4.

During the turning of barrel unit 1, to the moment of movement starting of the slide 5, the cylinder catch 37 is got out of the engagement with special retaining groove on the front surface of the cylinder and it permits the cylinder to turn freely around its axle. When the cylinder 16 is turning at required angle to put the next powder-chamber on the barrel line, the catch 37 of cylinder enters once again the suitable groove of cylinder, stops the cylinder turning and fixes it in needed position.

The slide 5 is moving backwards under the action of the recoil spring 13 of the slide without the engagement with the cylinder 16. At the turning, the barrel unit 1, by its rear part, acts on the spring-loaded retainer 35 of kickback compensator, this retainer is located in the suitable cavity of upper part of the grip rear wall of revolver and release the kickback compensator. When the barrel unit 1 is turning, at the hammer put into the firing cock, the portion of movement energy of barrel unit is transmitting to kickback compensator body 28 through the push-rod 31 and the compensator accelerator 32. As a result, the kickback compensator performs the opposite movement relative to the barrel unit movement. When the slide 5 reaches the rear limit position between the barrel unit 1 and the kickback compensator, the opposite collision is occurred. As the movement vectors of mass centers of barrel unit and the kickback compensator are equal in the moment of collision by absolute value and are opposite by direction, the shot kickback is suppressed.

Then, as a result of action of recoil spring 30 of kickback compensator, the barrel unit 1 and the compensator body perform the reverse movements.

At the reverse movement of barrel unit 1 the slide 5 occupies the front limit position under the action of recoil spring 13. The slide retainer 6 is turning around its axle 10 under the action of recoil spring 30 of compensator and locks the slide 5. At the turning the slide retainer 6 acts on the slide accelerator 11 and occupies the initial position.

As a result of reverse movement of kickback compensator, the spring-loaded retainer 35 of compensator locks the compensator when it reached the initial position.

The design of the automatic revolver described above is one of the versions of practical realization of the method of arm automatics operation using the negative features of any small arms for actuating the automatics.

At the formed traditions, the invention improves the operational characteristics with kept classic proportions of the arm. The dynamic stabilization of the arm in process of shooting owing to the mechanical kickback compensator arranged into the grip permits to improve the shot precision and to decrease considerably the tension force of the shot's hand.

The technical result of the method in accordance with the invention is the elimination of negative influence of the arm of force occurring in shooting. The practical use of operation method of arm automatics is possible for various kinds of short-barrel arms, not only of revolver type. The method offers the opportunity to create various modifications of reliable, handy in use, powerful quick-firing arm of revolver type both of classic appearance and with elements of modem design.

What is claimed is:

1. An automatic revolver, comprising:

a frame including a grip;

a barrel unit including a cylinder which is adapted to receive a plurality of cartridges including cartridge cases, and a barrel bore, wherein said cylinder is rotatable to alternately align one of said cartridges with said barrel bore;

a slide including tubular and rear parts, a slide retainer, a slide accelerator, a mechanism for translational-rotational movement of said slide and an engagement mechanism for engaging a bottom of a cartridae-case after firing, wherein said tubular part is arranged at least partially under said barrel bore and includes a main-spring and a recoil spring with a retainer rod;

an arm kickback compensator arranged in said grip; and a transversal axle for movably connecting said barrel unit to said frame, wherein said transversal axle is arranged under said cylinder to enable said barrel unit to turn about said transversal axle relative to said frame.

2. The automatic revolver of claim 1, wherein said barrel unit further comprises a catch arranged in front of said cylinder for stopping and fixing said cylinder.

3. The automatic revolver of claim 1, wherein said grip includes a cavity, and said arm kickback compensator is arranged in said cavity.

4. The automatic revolver of claim 3, wherein said arm kickback compensator comprises a compensator body movably fastened in said cavity and coupled to said slide retainer by a movable lever system.

5. The automatic revolver of claim 4, wherein said movable lever system comprises a compensator accelerator and a transmitting rod movably connected to said compensator accelerator and to said slide retainer.

6. The automatic revolver of claim 5, wherein said slide retainer comprises a double-armed lever rotatable about said transversal axle and engaging on one side with said slide accelerator and on an opposite side with said transmitting rod.

7. The automatic revolver of claim 4, wherein said compensator body comprises a groove including an upper open end, further comprising a recoil spring arranged in said groove and a recoil spring push-rod including a first end arranged in said groove and biased by said recoil spring.

8. The automatic revolver of claim 7, wherein said recoil spring push-rod includes a second end opposite to said first end which is in contact with a rear part of said barrel unit.

9. The automatic revolver of claim 3, wherein said arm kickback compensator includes a retainer movably fastened to a rear wall of said cavity.

10. The automatic revolver of claim 1, wherein said mechanism for translational-rotational movement of said slide comprises a curvilinear copy slot arranged on an outer surface of said tubular part of said slide and a guide tooth arranged in said barrel unit in a position to engage said copy slot during shooting.

11. The automatic revolver of claim 10, wherein said barrel unit includes a slide groove, and said tubular part of said slide and said guide tooth are arranged in said slide groove.

12. The automatic revolver of claim 1, wherein said engagement mechanism comprises a spring-loaded breech ring and a spring-loaded cartridge-case extractor.

13. The automatic revolver of claim 1, wherein said tubular part comprises a rotation axle of said cylinder.

14. The automatic revolver of claim 1, wherein said transversal axle is arranged relative to said barrel unit to enable said barrel unit to turn in a vertical plane about said transversal axle relative to said frame.

* * * * *